United States Patent [19]

Skvortsov et al.

[11] 3,998,265

[45] Dec. 21, 1976

[54] CRYSTALLIZER POSITIONING AND DISPLACING APPARATUS

[76] Inventors: Gennady Fedorovich Skvortsov, Prospekt Karla Marxa, 25, kv. 26; Lev Seliverstovich Kazantsev, ulitsa Rimskogo-Korsa-kova, 11, kv. 69; Andrei Grigorievich Pomeschikov, ulitsa Rimskogo-Korsa-kova, 10, kv. 2, all of Novosibirsk, U.S.S.R.

[22] Filed: Feb. 20, 1976

[21] Appl. No.: 659,726

[52] U.S. Cl. ..... 164/342; 164/344; 164/407; 164/DIG. 6; 164/252

[51] Int. Cl.[2] ..... B22D 29/04

[58] Field of Search ..... 164/52, 252, 342, 343, 164/344, DIG. 6, 405, 407, 408, 404; 249/161; 13/9

[56] References Cited

UNITED STATES PATENTS

| | | | |
|---|---|---|---|
| 1,706,724 | 3/1929 | Anderson | 164/407 |
| 1,715,620 | 6/1929 | Perry | 249/161 X |
| 1,803,299 | 4/1931 | Fahlman | 249/161 X |
| 3,670,089 | 6/1972 | Paton et al. | 164/52 UX |
| 3,804,146 | 4/1974 | Hoyle | 164/52 X |

FOREIGN PATENTS OR APPLICATIONS

| | | | |
|---|---|---|---|
| 501,786 | 3/1951 | Belgium | 164/342 |

*Primary Examiner*—Ronald J. Shore
*Attorney, Agent, or Firm*—Lackenbach, Lilling & Siegel

[57] ABSTRACT

The disclosed crystallizer positioning and displacing apparatus includes a movable carriage with grippers adapted to engage the suspension shaft of the crystallizer, the carriage also having at least two wedge-shaped abutments adapted to abut against wedge-shaped lugs mounted on the crystallizer in alignment with these abutments, the wedge-shaped abutments and the wedge-shaped lugs being situated below the suspension shaft of the crystallizer.

2 Claims, 5 Drawing Figures

CRYSTALLIZER POSITIONING AND DISPLACING APPARATUS

The present invention relates to metal remelting plants and, more particularly, it relates to apparatus for positioning and displacing a crystallizer, as the latter is lifted off an ingot.

The invention can be utilized in ferrous metallurgy, particularly, in electroslag remelting furnaces, although it can also be utilized in other plants for remelting metals and their alloys in specific branches of metallurgy.

Various apparatus for positioning and displacing a crystallizer are widely known in the art, such apparatus in most cases includes a movable carriage reciprocated by an appropriate driving mechanism along the vertical column of either a furnace or a remelting plant. The lateral surface of the movable carriage has either an engagement plane or a bracket with a flange, to which the crystallizer is fixedly secured. By means of the carriage the crystallizer can be lowered and placed upon the ingot stool. As the melting operation is completed, the carriage is driven upwardly along the column to lift the crystallizer off the ingot, until the latter is released.

However, the abovedescribed known crystallizer positioning and displacing apparatus is not free from certain drawbacks of which the major ones are complicated operation, the labor-consuming operations of dismantling and remounting the crystallizer for cleaning and maintenance purposes, since every fastener or bolt is to be undone and then re-positioned and secured every time such maintenance and cleaning operations are performed, which also involves a waste of production time.

There is known a type of crystallizer positioning and displacing apparatus which is usually incorporated in electroslag remelting furnaces, which includes a carriage reciprocable along the vertical column of the furnace. The lateral surface of the movable carriage, facing the crystallizer, has mounted thereon in a cantilever fashion two horizontally extending grippers. Correspondingly, the lateral surfaces of the crystallizer have two support brackets provided thereon along the axis of the crystallizer, extending at 90° with respect to these grippers. The crystallizer is unfixedly placed on the ingot stool, whereas the movable carriage is positioned on the column of the furnace so that its grippers shall be situated below these support brackets of the crystallizer. To lift the crystallizer off an ingot, the carriage is driven upward, its grippers approaching from below the support brackets of the crystallizer, engaging them and lifting the crystallizer to release the ingot.

However, the last-described crystallizer positioning and displacing apparatus is also not free from disadvantages. The gravity center of the crystallizer is practically never aligned with the axis of the latter, along which the support brackets thereof are arranged, because considerably heavy and massive cooling conduits are connected to the crystallizer on the side thereof which faces the column of the furnace. As the crystallizer is being lifted off the ingot, its suspension from the movable carriage is unbalanced and insufficiently reliable, since the crystallizer is practically suspended at only two support points. The resulting tilting torque is liable to cause jamming of the crystallizer at the ingot, and, consequently, an increased wear of the respective internal walls of the crystallizer.

It is an object of the present invention to eliminate the abovespecified drawbacks and disadvantages.

It is another object of the present invention to create a crystallizer positioning and displacing apparatus of a simple structure which is convenient and reliable in operation and is particularly adapted for incorporation in electroslag remelting furnaces.

These and other objects are attained in a crystallizer positioning and displacing apparatus, wherein a movable carriage has grippers adapted to engage the suspension shaft of the crystallizer, in which apparatus, in accordance with the present invention, the movable carriage at the side thereof, where the grippers are arranged thereon, is provided with at least two wedge-shaped abutments, the crystallizer being provided with respective wedge-shaped lugs in alignment with these abutments, the lugs being adapted to abut against the respective wedge-shaped abutments, when the crystallizer is retained on the carriage, the wedge-shaped abutments and the respective wedge-shaped lugs being situated below the suspension shaft of the crystallizer.

It is expedient that the wedge-shaped abutments of the carriage should be adjustable, each abutment including, preferably, a support bracket with a guideway groove supporting therein a wedge-shaped slide reciprocable along the groove by means of a screw which is also engaged in the support member, the inclined surface of the wedge-shaped slide facing upward.

The herein disclosed crystallizer positioning and displacing apparatus is of a simple structure and convenient in operation. The provision of the wedge-shaped abutments on the carriage and of the respective wedge-shaped lugs on the crystallizer ensures reliable and stable retaining of the crystallizer on the carriage without incorporation of any additional permanent fasteners, e.g. bolts.

With the wedge-shaped abutments being adjustable, the operation of aligning the crystallizer with respect to the ingot stool is speeded up, and its performance becomes facilitated; furthermore, it is possible to compensate for manufacturing and assembling errors inherent both in the crystallizer and in the apparatus as a whole.

The incorporation of the herein disclosed apparatus has been found to facilitate and speed up the entire process of releasing a built-up ingot, to ensure safe, rapid and readily-releasable suspension and retaining of the crystallizer on the carriage and to display no tendency by the crystallizer to tilt while being displaced, whereby no jamming efforts are produced, and the wear of the internal walls of the crystallizer is minimized.

The present invention will be further described in detail in connection with an embodiment thereof, with reference being had to the accompanying set of drawings, wherein:

FIG. 1 schematically illustrates a crystallizer positioning and displacing apparatus, wherein the movable carriage is provided with two wedge-shaped abutments, while the crystallizer is provided with respective wedge-shaped lugs aligned with the abutments, in accordance with the invention;

Figure 1:
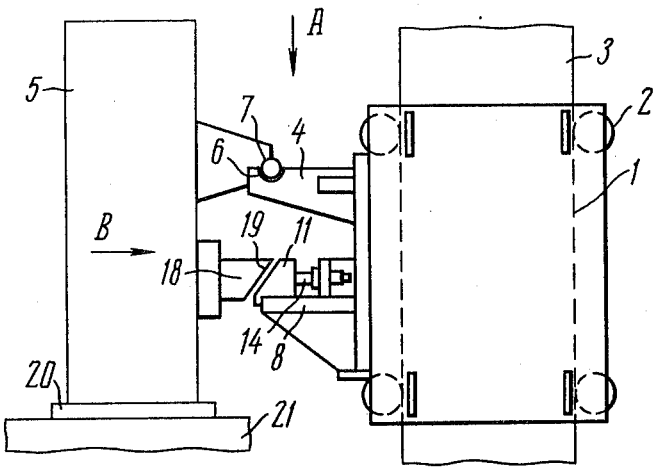
Figure 2:
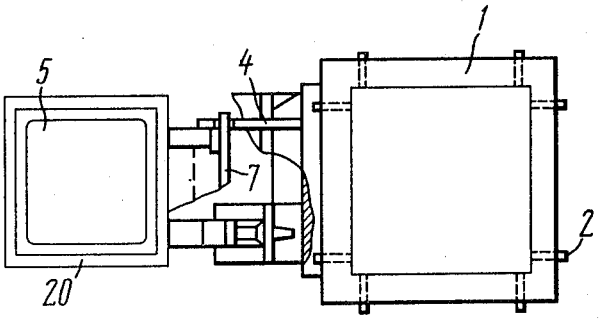
FIG. 2 is a top view partly broken-away along arrow line A in FIG. 1 displaying one of the abutments.
Figure 3:
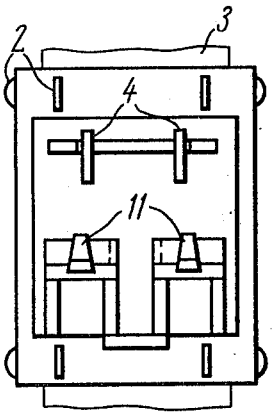
FIG. 3 is a view taken along arrow line B in FIG. 1.

Referring now in particular to the appended drawings, FIGS. 1, 2 and 3, the crystallizer positioning and displacing apparatus includes a movable carriage 1 of a commonly known welded structure, which is provided with rollers 2 adapted to engage and move along the vertical column 3 of an electroslag remelting furnace. The lateral surface of this movable carriage 1 has welded thereto two grippers 4 extending horizontally with respect to the column 3 and adapted to engage the crystallizer 5. The free ends of the grippers 4 have made therein aligned, upwardly-facing notches 6 (FIG. 1) adapted to receive therein the suspension shaft 7 secured to the lateral surface of the crystallizer 5. This suspension shaft 7 of the crystallizer 5 in the presently described embodiment is in the form of a round rod. The lateral surface of the movable carriage 1 has two wedge-shaped abutments 8 mounted thereon below the grippers 4, to serve as an additional support for the crystallizer 5.

Figure 4:
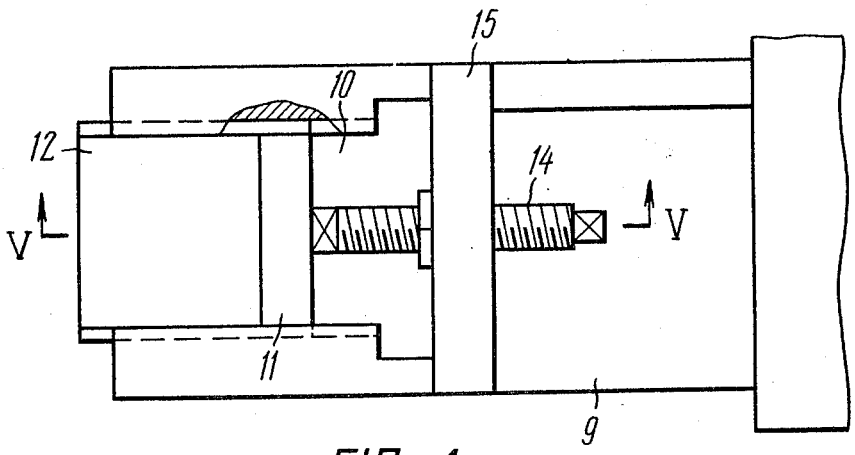
FIG. 4 is an enlarged top view of a modification of the wedge-shaped abutments.

In this preferred embodiment each wedge-shaped abutment 8 includes a support bracket 9 (FIGS. 4 and 5) with a horizontally extending dovetail-shaped guideway groove 10 made therein. The groove 10 supports therein a wedge-shaped slide 11 having an inclined surface 12 facing upward, the inclination of this surface being toward the crystallizer 5 (FIG. 1). The wedge-shaped slide 11 (FIG. 5) has a slot 13 cut therein, to receive the head of a screw 14 retaining the wedge-shaped slide 11 in an adjusted position. For this purpose the support bracket 9 is provided with a vertical rib 15 having therein a threaded opening 16 for receiving the threaded portion of the screw 14. A lock nut 17 is provided to lock the screw 14 in an adjusted position.

The crystallizer 5 (FIG. 1) has two wedge-shaped lugs 18, also of a welded structure, secured thereto on the same side where the suspension shaft 7 is arranged, the lugs 18 being positioned in alignment with the wedge-shaped abutments 8 of the movable carriage 1. The wedge-shaped lugs 18 are situated below the suspension shaft 7 of the crystallizer 5, the spacing of the wedge-shaped lug 18 from the suspension shaft 7 of the crystallizer 5 equalling the spacing of the wedge-shaped abutment 8 from the respective gripper 4 of the movable carriage 1.

Each wedge-shaped lug 18 has an inclined surface 19, its respective downward inclination angle equalling that of the inclined surface 12 (FIG. 5) of the wedge-shaped slides 11, i.e. the inclined surfaces are parallel to one another.

To perform a remelting operation, the crystallizer 5 is positioned to rest by its bottom flange 20 on an ingot stool 21 which is usually supported by a trolley.

The herein disclosed crystallizer positioning and displacing apparatus is adjusted and operates, as follows.

The crystallizer 5 (FIG. 1) resting on, but not secured to, the horizontally adjusted ingot stool 21 is advanced on the trolley (not shown) to underlie the furnace, so that the suspension shaft 7 of the crystallizer 5 should align with the axis of the notches 6 of the grippers 4 of the movable carriage 1, with the latter having been positioned on the column 3 in advance for its grippers 4 to underlie the suspension shaft 7 of the crystallizer 5.

At an appropriate moment the movable carriage 1 is driven upwardly along the column 3, the notches 6 of the grippers 4 engaging the suspension shaft 7 of the crystallizer 5, and the wedge-shaped slides 11 of the abutments 8 engaging the wedge-shaped lugs 18, whereby the crystallizer 5 becomes firmly and fixedly suspended from the movable carriage 1.

When this is attained, the movable carriage 1 is arrested and slightly lowered until the gap between the bottom flange 20 of the crystallizer 5 and the ingot stool 21 equals 30 to 40 mm, i.e. until it becomes sufficient for visual inspection.

Figure 5:
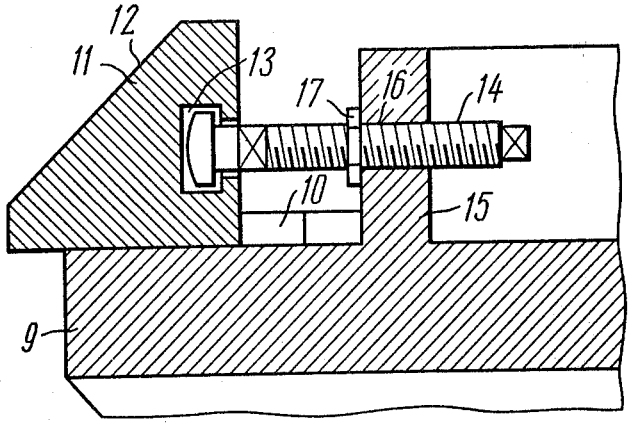
FIG. 5 is a cross sectional view taken along the line V—V in FIG. 4.

Then, to adjust the crystallizer 5 strictly vertically, the adjustable wedge-shaped abutments 8 are operated, the screws 14 (FIG. 5) being rotated in the appropriate directions in the threaded openings 16, whereby the wedge-shaped slides 11 are displaced in the grooves 10 until the plane of the bottom flange 20 (FIG. 1) of the crystallizer 5 becomes parallel with the supporting surface of the ingot stool 21. The adjusted position of the screws 14 is additionally fixed by being locked with the lock nuts 17 (FIG. 5).

This done, the movable carriage 1 is driven downward to lower the crystallizer 5 (FIG. 1) onto the ingot stool 21, whereafter the movable carriage 1 is lowered still further until its grippers 4 completely disengage the suspension shaft 7 of the crystallizer 5.

The apparatus adjusted in the abovedescribed manner is ready for operation and provides for further operation of the furnace (i.e. of the plant) with the given crystallizer without any additional adjustment.

To lift the crystallizer off a built-up ingot, the movable carriage 1 is driven upward, its grippers 4 engaging by their notches 6 the suspension shaft 7 and thus lifting the crystallizer 5, the latter also having its wedge-shaped abutments 18 abutting against and thus resting upon the wedge-shaped lugs 8 of the movable carriage 1.

In this way proper, i.e. tilt-free, lifting of the crystallizer off the ingot is ensured. Owing to the presence of the inclined surfaces 12 of the wedge-shaped slides 11 facing upwardly at a specified angle, the grippers of the carriage are partly relieved of their load, and the entire operation of lifting the crystallizer off the ingot is facilitated.

What is claimed is:

1. A crystallizer positioning and displacing apparatus comprising: a crystallizer with a suspension shaft; a movable carriage with gripping means adapted to engage the suspension shaft of said crystallizer; at least two wedge-shaped abutments provided on said movable carriage on the side thereof where said gripping means are arranged; wedge-shaped lugs provided on said crystallizer in alignment with said wedge-shaped abutments, said crystallizer being adapted to have said wedge-shaped lugs thereof abut against said wedge-shaped abutments when said crystallizer is retained on said movable carriage; said wedge-shaped abutments and the respective wedge-shaped lugs being situated below said suspension shaft of said crystallizer.

2. An apparatus as set forth in claim 1, wherein said wedge-shaped abutments of said movable carriage are adjustable and each abutment includes a support bracket having made therein a guideway groove supporting therein a wedge-shaped slide movable in this groove by means of a screw also secured in the support bracket, the inclined surface of said wedge-shaped slide facing upward.

* * * * *